US011457743B1

(12) United States Patent
Ruijpers et al.

(10) Patent No.: US 11,457,743 B1
(45) Date of Patent: Oct. 4, 2022

(54) FOLDING CHAIR WITH ARTICULATED ARMRESTS

(71) Applicant: True Places, Inc., Wallingford, PA (US)

(72) Inventors: Bart Ruijpers, New York, NY (US); Jonathan D. Albert, Philadelphia, PA (US); Breanna Stachowski, Elma, NY (US); Ben Knepler, Philadelphia, PA (US); Nelson Warley, Philadelphia, PA (US)

(73) Assignee: True Places, Inc., Wallingford, PA (US)

( * ) Notice: Subject to any disclaimer, the term of this patent is extended or adjusted under 35 U.S.C. 154(b) by 0 days.

(21) Appl. No.: 17/329,238

(22) Filed: May 25, 2021

Related U.S. Application Data

(60) Provisional application No. 63/032,869, filed on Jun. 1, 2020.

(51) Int. Cl.
*A47C 4/28* (2006.01)
*A47C 4/04* (2006.01)
*A47C 7/54* (2006.01)

(52) U.S. Cl.
CPC ..... *A47C 4/04* (2013.01); *A47C 4/286* (2013.01); *A47C 7/54* (2013.01)

(58) Field of Classification Search
CPC ..... A47C 4/04; A47C 4/045; A47C 4/283; A47C 4/286; A47C 7/54
USPC ..... 297/45
See application file for complete search history.

(56) References Cited

U.S. PATENT DOCUMENTS 4,243,263 A * 1/1981 Thiboutot ..... A47C 4/286 297/45 X
4,245,849 A * 1/1981 Thiboutot ..... B62B 13/16 297/45 X
4,645,260 A * 2/1987 Harty ..... A47C 4/20 297/45 X
5,058,950 A * 10/1991 Mann ..... A47C 4/286 297/45 X
6,464,242 B2 * 10/2002 Suzuki ..... B62B 7/08 297/45 X
2014/0138990 A1 * 5/2014 Chesness ..... A47C 4/286 297/16.1

FOREIGN PATENT DOCUMENTS

JP 3141752 U * 5/2008 ..... A47C 4/286

* cited by examiner

*Primary Examiner* — Rodney B White
(74) *Attorney, Agent, or Firm* — Blank Rome LLP

(57) ABSTRACT

A folding chair includes an articulated armrest to initiate a folding of the chair. The armrest can have a spring-loaded, releasable coupling, where the chair will not fold inadvertently, while lifting the chair by the armrests, without release of the coupling. The folding armrests can be linked to movement of the seat structure during chair folding. The chair can include four leg posts, two articulated armrests, where each armrest is rigid and has a front and rear arm section, and two seat links, where each seat link is pivotally attached to one of the front or the rear arm section, and to a side support of a seat bottom, where the chair is configured, when the armrests are articulated, to fold the chair. A releasable coupling can be included, between the front and the rear arm sections, where, when the coupling is released, the chair is folded.

17 Claims, 8 Drawing Sheets

FOLDING CHAIR WITH ARTICULATED ARMRESTS

RELATED APPLICATION

This application claims benefit of priority of U.S. Provisional Application Ser. No. 63/032,869, filed Jun. 1, 2020; which application is incorporated herein by reference.

FIELD OF THE INVENTION

The present invention relates generally to folding chairs, and more particularly to a folding chair with articulated armrests, where, upon a folding of the armrests, the chair folds.

BACKGROUND OF THE INVENTION

Folding chairs using a scissor linkage are well known in the art, as shown in FIG. 1. These chairs are simple, and the folding scissor linkages (below the seat) give the chair greater stability as it is loaded with the weight of the user. Folding chairs with scissor linkage typically do not have rigid armrests and instead utilize an armrest of fabric. A fabric armrest is not desirable as it does not provide the stability or comfort as a rigid armrest.

In order to provide rigid armrests, another design known in the art is shown in FIG. 2. This design does provide rigid armrests, but only folds in one dimension into a flat, but still wide width, storage shape. The prior art folding chair of FIG. 2 is not as compact as is desired for true portability.

SUMMARY OF THE INVENTION

The present invention is a folding chair that includes an articulated armrest that mechanically folds the armrest when the chair is folded (i.e., collapsed). The armrest can have a spring-loaded, releasable coupling (or latch), where the chair will not fold inadvertently, while lifting the chair by the armrests, without release of the coupling. In addition, the folding armrests are linked to the movement of the seat structure, during a folding, or collapsing, of the chair. This releasable coupling ensures that all aspects of the chair fold (collapse) in unison.

In one aspect of the present invention, a folding chair includes four leg posts, at least one armrest, each armrest having a rigid front arm section communicating with a front post, and a rigid rear arm section communicating with a rear post, where the folding chair is configured, when the front arm section is folded relative to the rear arm section, to fold the chair.

In this aspect, the chair can further include a series of scissor linkages configured to maintain the posts parallel relative to one another during folding and unfolding of the chair. The chair could also include two seat links, each seat link being pivotally attached, at a top thereof, to one of the front or the rear arm sections, and pivotally attached, at a bottom thereof, to a side support of a seat bottom, where the seat links are configured, when the armrests are folded, to lift the side supports of the seat bottom.

The side supports of the seat bottom can be rigid, and not fold during folding of the chair. In this aspect, the chair folds in two dimensions, collapsing in each of a width and a depth dimension. During chair folding, the seat bottom moves toward a seat back.

Also, in this aspect, the chair can include a releasable coupling between the front and the rear arm sections, where, when the coupling is released, to fold the front arm section relative to the rear arm section, and to thereby fold the chair.

In another aspect of the present invention, a folding chair includes four leg posts, two rigid armrests, each armrest having a front arm section communicating with a front post, a rear arm section communicating with a rear post, and a releasable coupling between the front and the rear arm sections, where the folding chair is configured, when the coupling is released, to allow the chair to fold. Here, when the coupling is released, each rigid armrest can fold relative to the other.

In this aspect, the chair can also include two seat links, each seat link being pivotally attached, at a top thereof, to one of the front or the rear arm sections, and pivotally attached, at a bottom thereof, to a side support of a seat bottom, where the seat links are configured, when the armrests are folded, to lift the side supports of the seat bottom. The side supports of the seat bottom can be rigid and not fold during folding of the chair. In this aspect, the chair folds in two dimensions, collapsing in each of a width and a depth dimension. During chair folding, the seat bottom moves toward a seat back. The chair could also include a series of scissor linkages configured to maintain the posts parallel relative to one another during folding and unfolding of the chair.

In a further aspect, a folding chair includes four leg posts, two articulated armrests, each armrest having a rigid front arm section communicating with a front post, and a rigid rear arm section communicating with a rear post, and two seat links, each seat link being pivotally attached, at a top thereof, to one of the front or the rear arm sections, and pivotally attached, at a bottom thereof, to a side support of a seat bottom, where the chair folds when the armrests are articulated.

In this aspect, the seat links can lift the side supports of the seat bottom when the armrests are articulated. The side supports of the seat bottom can be rigid and not fold during folding of the chair. Also, in this aspect, the chair folds in two dimensions, collapsing in each of a width and a depth dimension. During chair folding, the seat bottom moves toward a seat back. The chair can further include a series of scissor linkages configured to maintain the posts parallel relative to one another during folding and unfolding of the chair.

BRIEF DESCRIPTION OF THE ILLUSTRATED EMBODIMENTS

The present invention will be better understood with reference to the following description taken in combination with the drawings. For the purpose of illustration, there are shown in the drawings certain embodiments of the present invention. In the drawings, like numerals indicate like elements throughout. It should be understood, however, that the invention is not limited to the precise arrangements, dimensions, and instruments shown:

Figure 1:
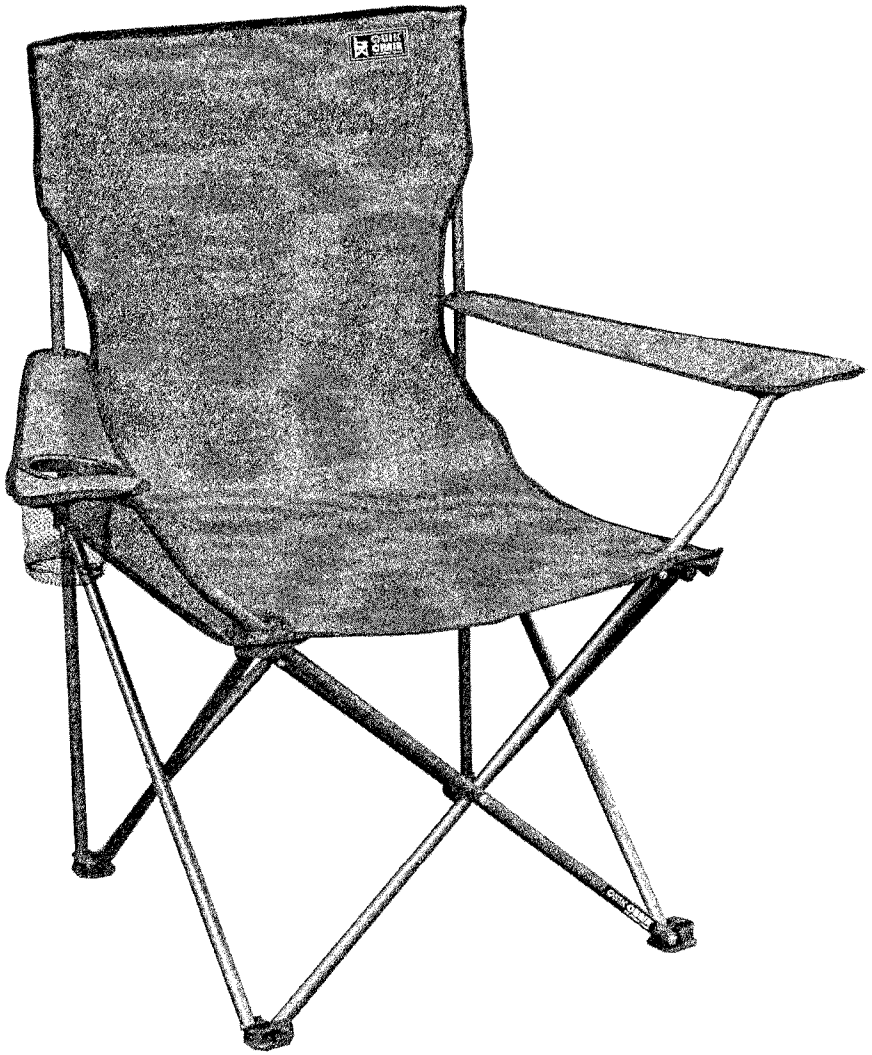
FIG. 1 (Prior Art)
FIG. 1 illustrates a prior art, fabric folding chair with scissor linkage, where the chair folds (or collapses) in two dimensions (width and depth)
Figure 2:
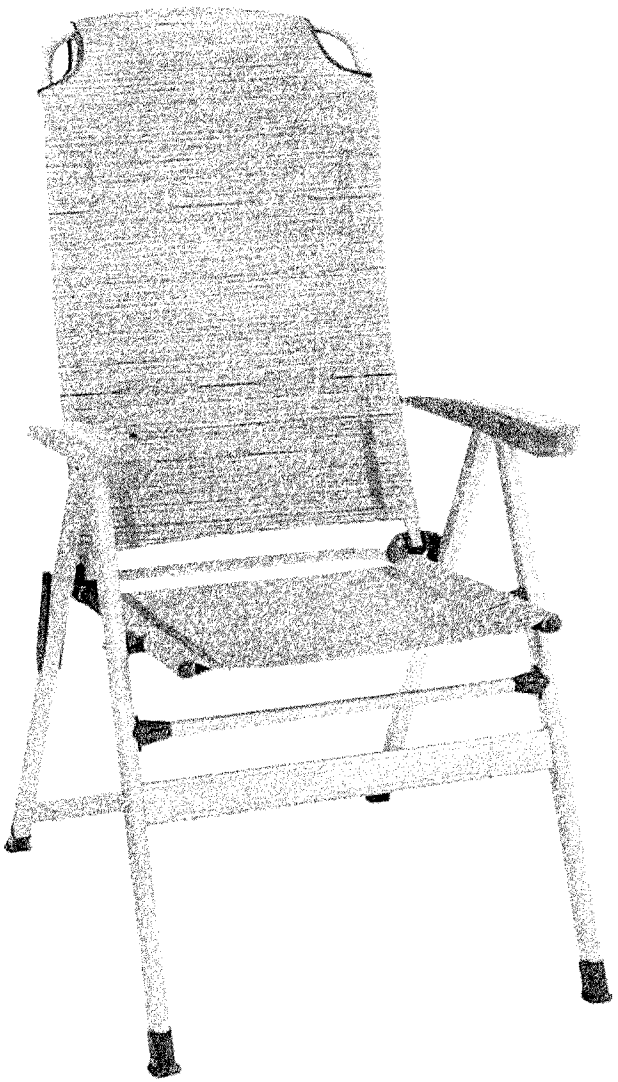
FIG. 2 (Prior Art)
FIG. 2 illustrates a prior art folding chair with rigid armrests, where the chair is limited to a folding in one dimension (depth)
Figure 3:
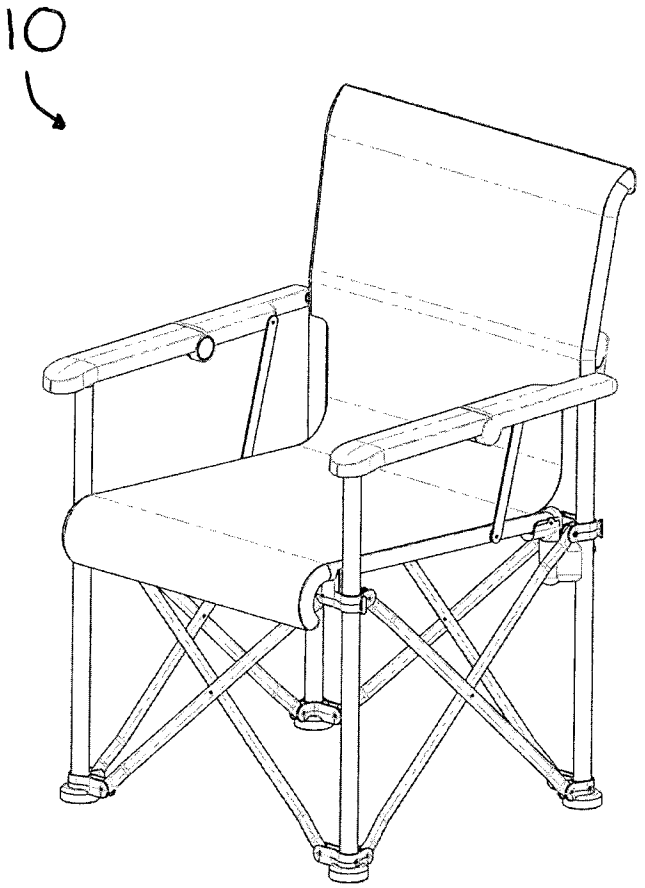
FIG. 3 illustrates a perspective view of a folding chair with articulated armrests, in an aspect of the present invention.
Figure 7:
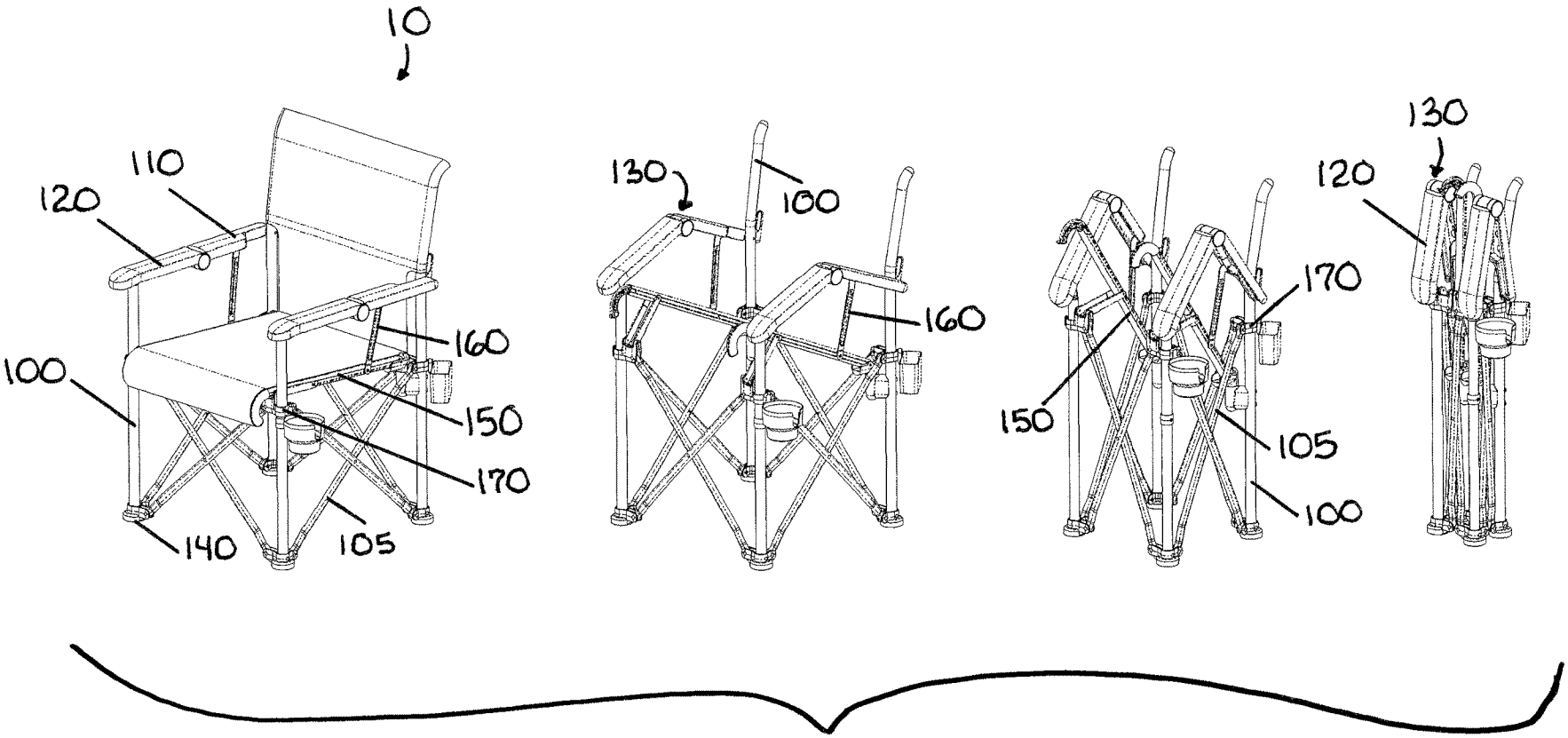
Figure 8:
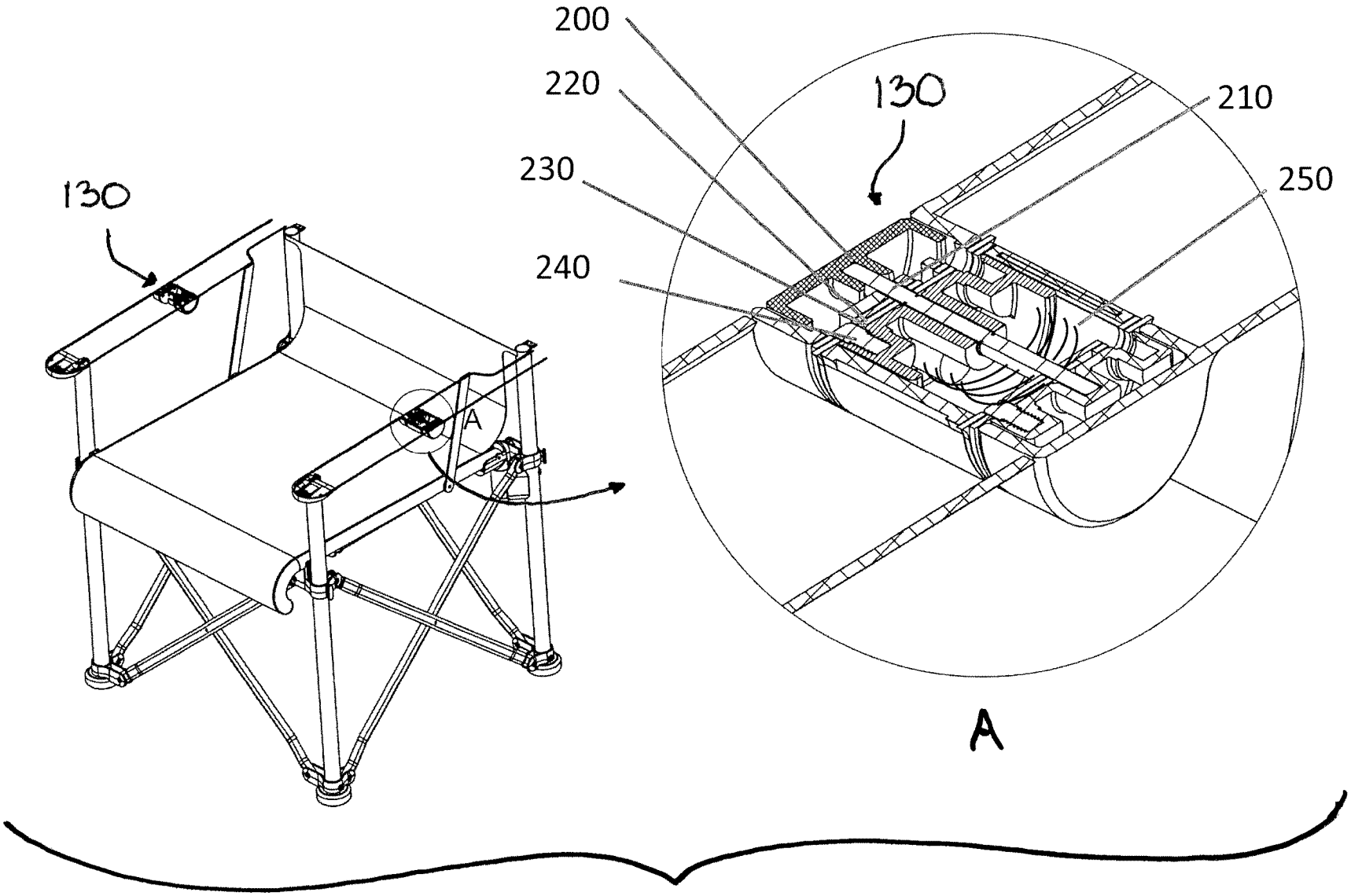

FIG. 7 illustrates the perspective view of the folding chair shown in FIG. 3 in various stages of folding, highlighting the folding (collapsing) of the chair in two dimensions, in an aspect of the present invention; and FIG. 8 illustrates the perspective view of the folding chair shown in FIG. 3, focusing on, and providing, an enlarged, cross-sectional view of a releasable coupling (latch), as an aspect of the present invention.

DETAILED DESCRIPTION OF THE ILLUSTRATED EMBODIMENTS

Figure 4:
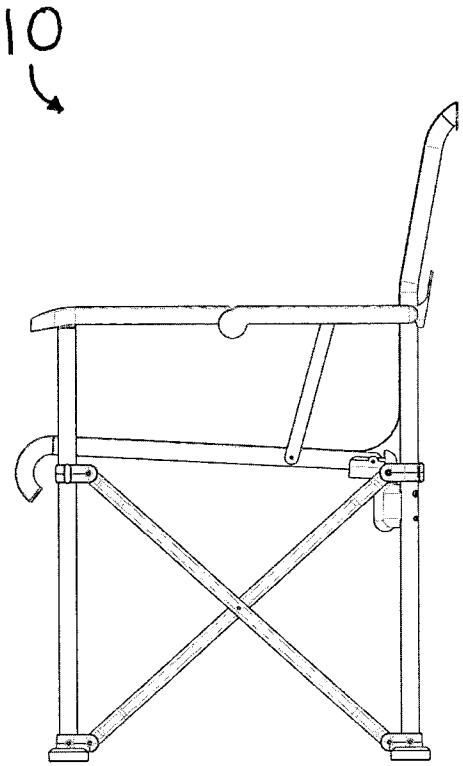
FIG. 4 illustrates a side view of the folding chair with articulated armrests shown in FIG. 3.
Figure 5:
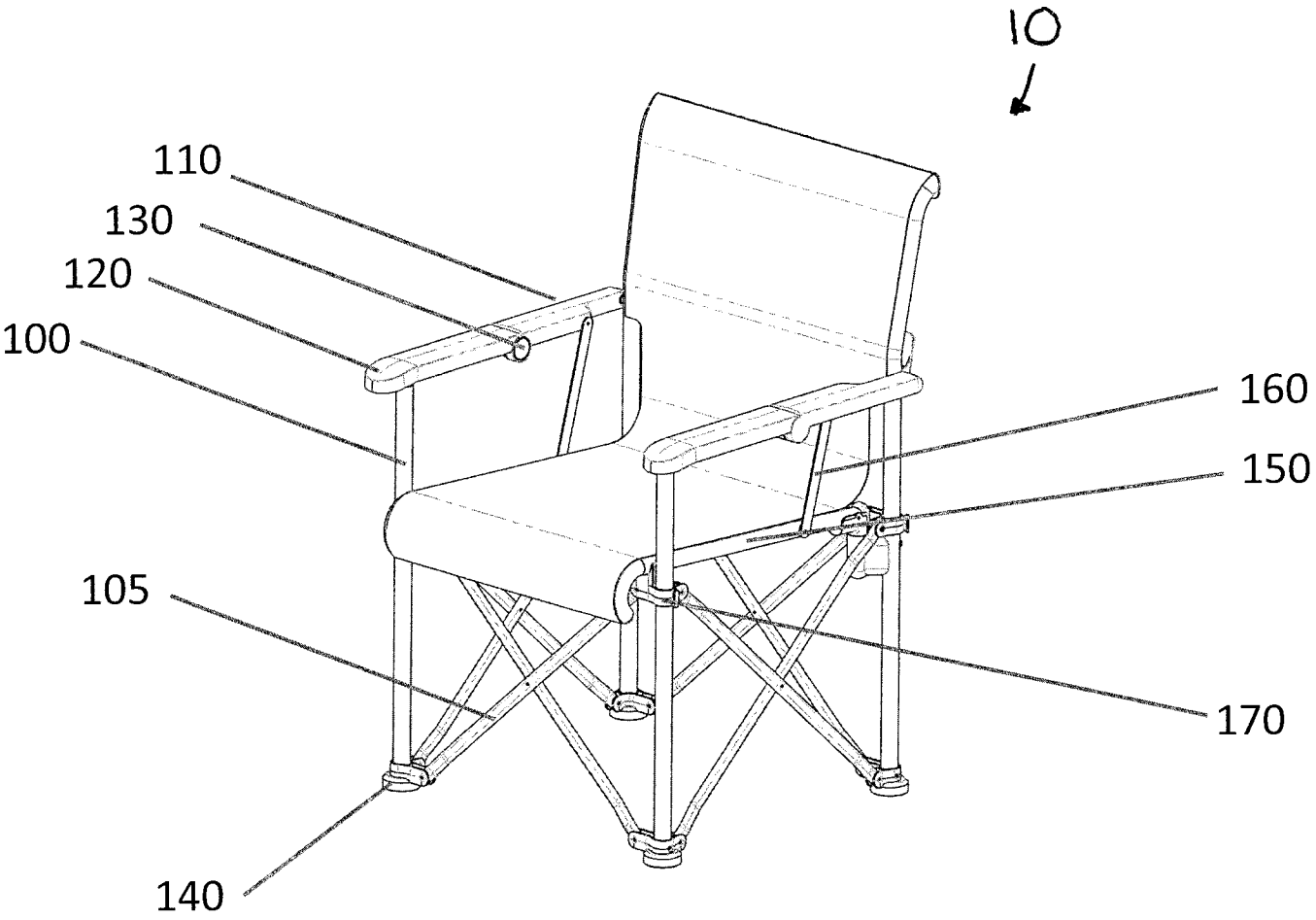
FIG. 5 illustrates the perspective view of the folding chair shown in FIG. 3 with component numbers.

One embodiment of the folding chair with articulated armrests of the present invention is shown in perspective in FIG. 3. A side view is illustrated in FIG. 4. FIG. 5 illustrates the perspective view of FIG. 3 with component numbers.

FIG. 5 illustrates certain, preferable features of the present invention. The folding chair 10 includes four corner posts (legs) 100, where the posts towards a rear of the chair 10 are longer than the posts towards a front. The longer length posts at the rear provide a support for a back of a seat of the chair 10.

There are four feet 140, one foot 140 located at a bottom of each of the posts 100. The four posts 100 communicate with one another through four scissor pairs (scissor linkages) 105. A lower point of each of the scissor linkages 105 communicates through a pivot to each of a foot 140 area of the post 100, and an upper point of each of the scissor linkages 105 communicates through a pivot to one of four corner pieces 170. Each corner piece 170 is configured to slide along a corner post (leg) 100 as the chair is folded and unfolded. The folding chair 10 is configured to fold in two dimensions, collapsing in each of a width and a depth dimension. During a folding of the chair 10, a bottom of a seat of the chair moves toward a back of the seat of the chair.

In one aspect, the armrest of the folding chair 10 includes a front arm section 120 and a rear arm section 110, the two arm sections 120, 110, communicating with one another via a pivot therebetween. The pivot can include a pivot pin or a pivot pin with spring-loaded latch (or releasable coupling) 130. The coupling 130 can be released using a latch button. When the latch button is depressed, the pivot is unlocked. Pressing the latch button of each of the releasable couplings 130 (i.e., on each of the two armrests) and lifting the hinged pivot area of each of the armrests, initiates a folding of the chair 10.

In another aspect, the rear arm section 110 of each armrest is pivotally attached to a seat link 160. The seat link 160 is pivotally attached at a top thereof to the rear arm section 110, and is pivotally attached at a bottom thereof to a side support (seat rail) 150 of a seat bottom. The seat link 160 lifts the side support 150 of the seat bottom when the chair 10 is folded. In one aspect, each side support 150 of the seat bottom is rigid and does not fold during a folding of the chair 10.

Figure 6:
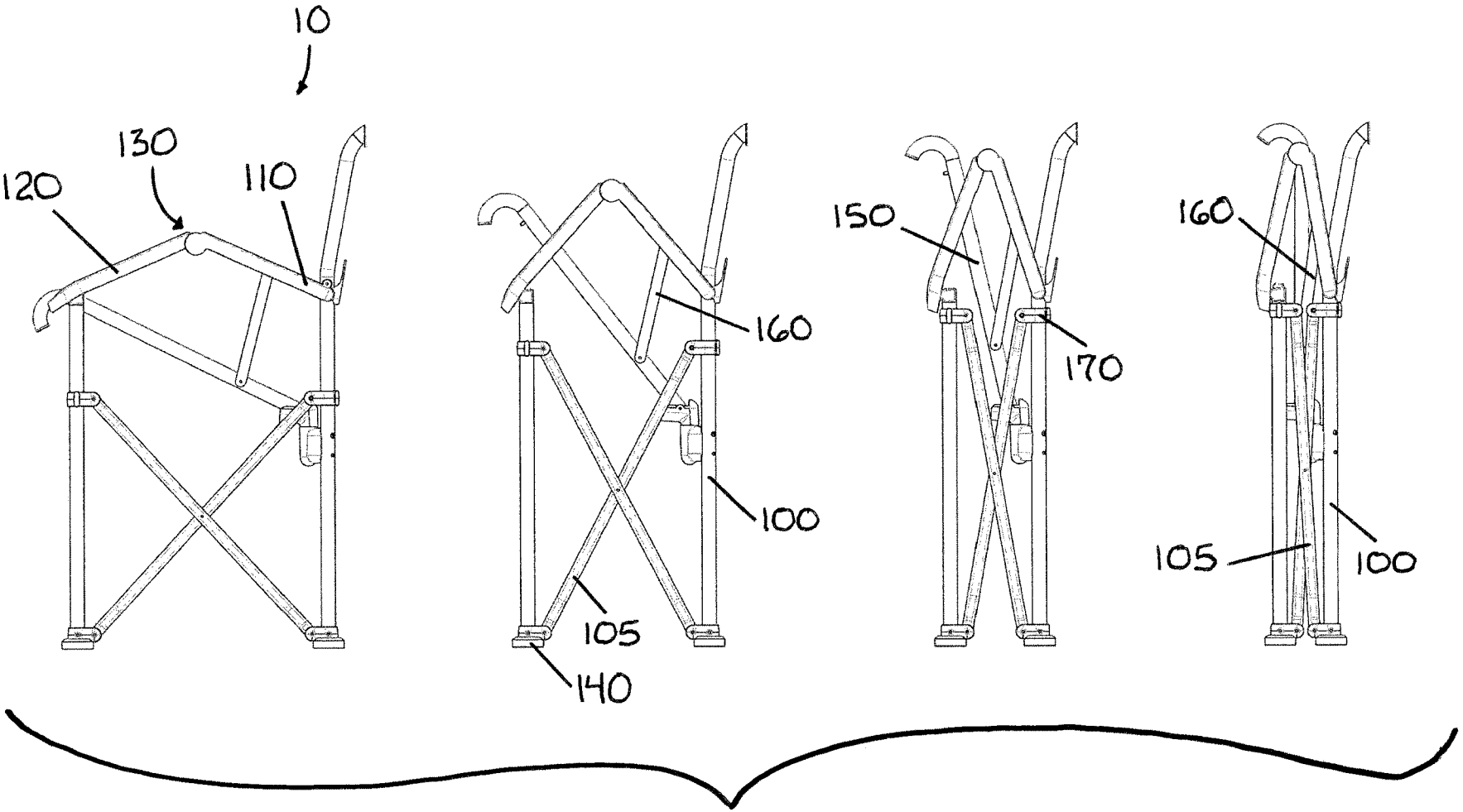
FIG. 6 illustrates the side view of the folding chair shown in FIG. 4 in various stages of folding, in an aspect of the present invention.

FIGS. 6 and 7 illustrate various stages of folding of the chair 10, respectively showing side and perspective views, where the fully folded chair 10 is shown at a right side of each figure. Due to the four sliding corner pieces 170, and the four scissor pairs 105, the four corner posts (legs) 100 all move towards one another during chair folding. As the front and back of the chair 10 move towards one another, the sides of the chair move together as well. Accordingly, the four scissor linkages 105 maintain the four corner posts 100 parallel relative to one another during folding and unfolding of the chair. The result, when folded, is a chair 10 fully collapsed, where the four corner posts 100 come together efficiently, leaving the chair 10 very compact for storage and transportation.

In one aspect of the present invention, the chair 10 might also include additional pivotal linkage between each of the front sliding corner pieces 170 and the side support 150 of the seat bottom. This feature is illustrated in FIG. 7 (middle views). In this aspect, the additional pivotal linkage serves to maintain secure connection of each front sliding corner piece 170 to the respective side support 150 of the seat bottom. In this aspect, each additional pivotal linkage could also include two planar linkages, one pivotally attached to an inside and one to an outside of the front sliding corner piece 170, at one end, and one pivotally attached to an inside and one to an outside of the respective side support 150 of the seat bottom, at the other end. In a certain aspect, a U-shaped groove may additionally be provided in a top of the front sliding corner piece 170 (see FIG. 7), where each side support 150 of the seat bottom is guided between the two planar linkages, during chair unfolding, into the U-shaped top of the front sliding corner piece 170.

FIG. 8 illustrates the perspective view of the folding chair shown in FIG. 3, focusing on, and also providing, an enlarged, cross-sectional view of a releasable coupling (latch) 130 of the present invention. A Latch button 200 is connected to a latch pivot shaft 210, providing a pivot to the armrest. One or more latch pins 240 are spring 250 loaded to engage a pair of plates 230 having a least one hole 220. When the one or more latch pins 240 are engaged with the plates 230, the armrest is locked, and the chair cannot be folded. Upon pressing the latch button 200, the latch pins 240 slide out of respective holes 220, and the plates 230 (which are connected to respective arm rest sections) are permitted to rotate relative to one another. A spring 250 biases the latch button 200, and ensures that the pins 240 are maintained in place until the chair is ready to be folded.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. For example, features detailed as included in certain specific embodiments above are recognized as interchangeable and possibly included in other detailed embodiments. Specific dimensions of any particular embodiment are described for illustration purposes only. It should therefore be understood that this invention is not limited to the particular embodiments described herein, but is intended to include all changes and modifications that are within the scope and spirit of the invention.

What is claimed is:

1. A folding chair comprising:

four leg posts;

at least one armrest, each armrest having a rigid front arm section communicating with a front post, and a rigid rear arm section communicating with a rear post; and two rigid side supports of a seat bottom, each rigid side support communicating with at least a respective rear post;

wherein the folding chair is configured, when the front arm section is folded relative to the rear arm section, to fold the chair; and wherein each rigid side support of the seat bottom does not fold during folding of the chair.

2. The folding chair of claim 1, further comprising a series of scissor linkages configured to maintain the posts parallel relative to one another during folding and unfolding of the chair.

3. The folding chair of claim 1, further comprising two seat links, each seat link being pivotally attached, at a top thereof, to one of the front or the rear arm sections, and pivotally attached, at a bottom thereof, to one of the two rigid side supports of the seat bottom, wherein the seat links are configured, when the armrests are folded, to lift the side supports of the seat bottom.

4. The folding chair of claim 1, wherein the folding chair is configured to fold in two dimensions, collapsing in each of width and depth dimension.

5. The folding chair of claim 4, wherein during folding of the chair, the two rigid side supports pivot toward a seat back.

6. The folding chair of claim 1, further comprising a releasable coupling between the front and the rear arm sections, wherein the folding chair is configured, when the coupling is released, to fold the front arm section relative to the rear arm section, and to thereby fold the chair.

7. A folding chair comprising:

four leg posts;

two rigid armrests, each armrest having a front arm section communicating with a front post, a rear arm section communicating with a rear post, and a releasable coupling between the front and the rear arm sections; and two rigid side supports of a seat bottom, each rigid side support communicating with at least a rear post;

wherein the folding chair is configured, when the coupling is released, to allow the chair to fold; and wherein each rigid side support of the seat bottom does not fold during folding of the chair.

8. The folding chair of claim 7, wherein the folding chair is configured, when the coupling is released, to allow each rigid armrest to fold.

9. The folding chair of claim 8, further comprising two seat links, each seat link being pivotally attached, at a top thereof, to one of the front or the rear arm sections, and pivotally attached, at a bottom thereof, to one of the two rigid side supports of the seat bottom, wherein the seat links are configured, when the armrests are folded, to lift the side supports of the seat bottom.

10. The folding chair of claim 7, wherein the folding chair is configured to fold in two dimensions, collapsing in each of a width and a depth dimension.

11. The folding chair of claim 10, wherein, during folding of the chair, the seat bottom moves toward a seat back.

12. The folding chair of claim 7, further comprising a series of scissor linkages configured to maintain the posts parallel relative to one another during folding and unfolding of the chair.

13. A folding chair comprising:

four leg posts;

two articulated armrests, each armrest having a rigid front arm section communicating with a front post, and a rigid rear arm section communicating with a rear post; and two rigid side supports of a seat bottom, each rigid side support communicating with at least a respective rear post;

wherein the folding chair is configured, when the armrests are articulated, to fold the chair; and wherein each rigid side support of the seat bottom does not fold during folding of the chair.

14. The folding chair of claim 13, further comprising two seat links, each seat link being pivotally attached, at a top thereof, to one of the front or the rear arm sections, and pivotally attached, at a bottom thereof, to one of the two side supports, wherein the seat links are configured, when the armrests are articulated, to lift the side supports of the seat bottom.

15. The folding chair of claim 13, wherein the folding chair is configured to fold in two dimensions, collapsing in each of a width and a depth dimension.

16. The folding chair of claim 13, wherein, during folding of the chair, the seat bottom moves toward a seat back.

17. The folding chair of claim 13, further comprising a series of scissor linkages configured to maintain the posts parallel relative to one another during folding and unfolding of the chair.

* * * * *